United States Patent [19]

Gentles et al.

[11] Patent Number: 4,798,553

[45] Date of Patent: Jan. 17, 1989

[54] ANIMATED TOYS

[76] Inventors: David G. Gentles, 1115 Ringwood Ave., Haskell, N.J. 07420; Mary A. Gentles, 68 Day St., Bloomfield, N.J. 07003

[21] Appl. No.: 105,736

[22] Filed: Oct. 7, 1987

[51] Int. Cl.[4] ..... A63H 3/16; A63H 17/25

[52] U.S. Cl. ..... 446/99; 446/287

[58] Field of Search ..... 446/97, 99, 100, 103, 446/237, 238, 287, 280, 288, 289, 373, 374; 74/421

[56] References Cited

U.S. PATENT DOCUMENTS

| | | | |
|---|---|---|---|
| 374,146 | 11/1887 | Essex | 74/421 R |
| 423,066 | 3/1890 | Massey | 446/73 |
| 1,506,554 | 8/1924 | Basso | 74/414 |
| 1,960,876 | 5/1934 | Passarelli | 446/374 |
| 2,585,781 | 2/1952 | Johnson | 446/99 |
| 2,692,443 | 10/1954 | Milligan | 434/401 |
| 2,725,234 | 11/1955 | Coble et al. | 273/157 R |
| 2,919,516 | 1/1960 | Schaefer | 446/92 |
| 3,050,900 | 8/1962 | Glass et al. | 446/97 |
| 3,193,292 | 7/1965 | Schaper | 273/352 |
| 3,193,293 | 7/1965 | Schaper | 446/103 |
| 3,212,200 | 10/1965 | Lundberg | 434/401 |
| 3,881,274 | 5/1975 | Kanda | 446/103 |
| 3,921,470 | 11/1975 | Mabuchi | 74/414 |
| 3,965,610 | 6/1976 | Den Ouden | 446/103 |

*Primary Examiner*—Robert A. Hafer
*Assistant Examiner*—Michael Brown
*Attorney, Agent, or Firm*—Dowell & Dowell

[57] ABSTRACT

Toy figures and characters which incorporate a plurality of one or more styles or shapes of rotatable gear-like components which are formed of soft, yieldable material and which components are selectively mounted to a variety of frames to thereby create toys having animated body parts that rotate as the toys are moved across a support surface.

19 Claims, 3 Drawing Sheets

FIG. 10
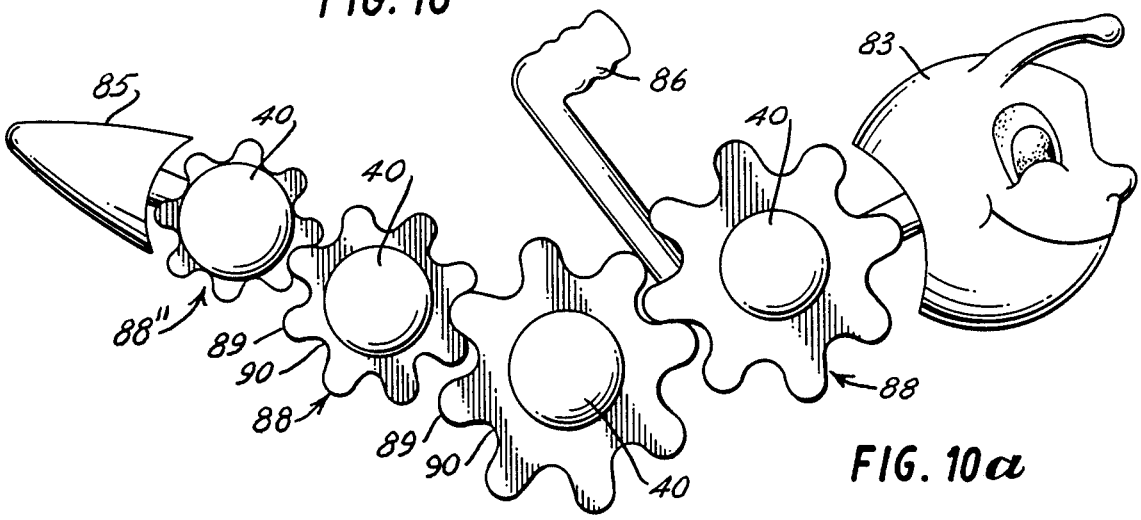
FIG. 10a
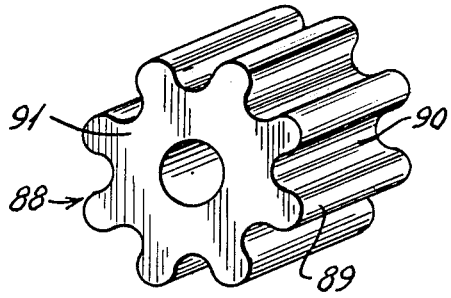
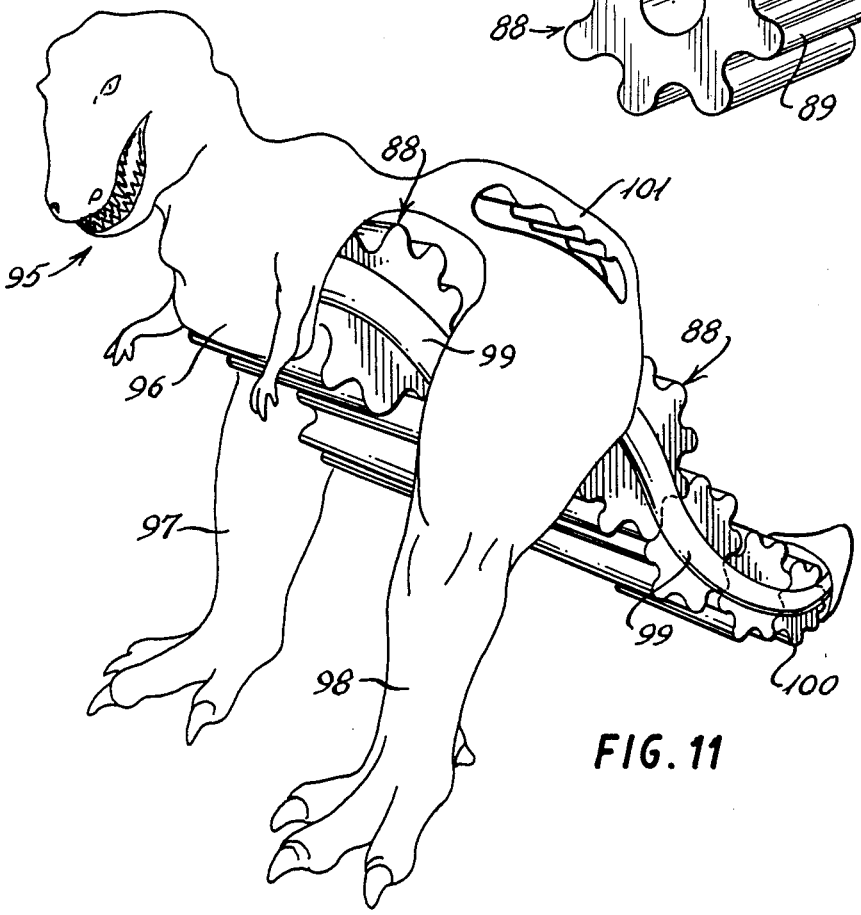
FIG. 11

ANIMATED TOYS

BACKGROUND OF THE INVENTION

1. Field of the Invention

This invention is generally directed to toy figures and characters and more specifically to toy figures and characters having animated body parts formed from a plurality of intermeshing gear-like elements which are selectively mounted to support frames. The primary movable components of the figure-like toys are made of a sponge or other soft and pliable rubber or plastic material which will readily deform in the event a person's finger or other appendage is placed between the inermeshing elements. A variety of gear or cogwheel elements may be provided so as to give different appearances to the various body portions which make up a character being assembled. In some embodiments, the gear-like elements may be interchangeable from one frame to another so that a plurality of differing characters may be created as desired. In one embodiment of the invention, a clown having a plurality of differing gear elements is disclosed wherein the gears forming the body portion of the clown are simultaneously rotated by intermeshing with gears which are disposed along the leg portions and adjacent the feet of the clown and which are movable as the clown is urged across a supporting surface.

In other embodiments of the invention, differing animal shapes are disclosed wherein the gear-like elements forming portions of the animals are brought into rotation as the toys are pushed across a floor or other supporting surface.

2. History of the Related Art

There is a going trend to encourage the development of games and toys for children which not only attract a child's attention but which also simultaneously encourage or stimulate increased motor control or provide other educational benefits. There have been a number of toys or games which have been designed which include structural components which must be assembled in order to create characters or figures. Many of these prior art toys take the form of building blocks, stackable rings or other three-dimensional forms which are mounted on a support base so as to create an object having three-dimensional characteristics. Some examples of this type of game or toy are disclosed in U.S. Pat. No. 423,066 to Massey and No. 2,725,234 to Coble et al. In each of these prior art references, various components are mounted upon a supporting frame in order to create a character having a specialized or unique form when the components are randomly assembled or to form a specific character if the components are properly assembled. Such toys do function to stimulate creativity and individuality by allowing components to be selectively assembled by a child. Further, such toys are educational in that if instructions are properly followed or if sizes are properly placed relative to one another, the created character will take the form of a predetermined character, structure or animal. However, in many such toys, once the toy has been assembled, the stimulus to the child diminishes as the assembled toy is a fixed three-dimensional character which has no moving components.

In practice, such sectionalized and assemblable toys have limited useful application for many children. After such toys have been repeatedly assembled and disassembled, children may no longer find the toy challenging or interesting and thereafter the toy is not utilized. In order to increase the useful interest or attention span in some assemblable type toys, designers began utilizing components which could be assembled in random patterns or forms so as to create characters or objects having a plurality of appearances. Some of these structures would enable children to assemble unique, funny, individualized characters which could be easily changed by changing component parts of the assembly. In this manner, children could utilize the toy repeatedly without becoming disinterested by always creating a single object or character. Again, such structures are limited to enabling the assembling and disassembling of various figures and are not specifically designed to promote the use of a toy in its assembled form.

Therefore, toy manufacturers have also looked to the possibility of creating toys which will be assembled and disassembled but which may also be useful and used by children in their assembled form. Many of today's most popular toys have been designed with these thoughts in mind and therefore offer children the ability to construct, operate and alter or modify a given toy as they desire. As an example, toys of this nature are being manufactured and sold under the trademarks of Erector Set, Lego's, Capsella and Robotex. One early form of toys which could be separately utilized after assembly to create or generate animated movement of interest to children is disclosed in U.S. Pat. No. 3,050,900 to Glass et al. In this reference, a toy figure is disclosed which could be assembled and incorporated a wind-up mechanism which would enable the figure to be movable by way of ground engaging wheels.

Unfortunately, many of the aforementioned toys and games which provide animation or some useful function after being assembled are not appropriately designed for most younger children. Either the components of such games or toys are too small for younger children to manipulate and assemble or they incorporate electrical motors and the like which are not recommended for use with small children due to the potential hazard of electrical shock. Further, some of these prior art toys include metallic components or other materials having sharp or serrated edges and which therefore are totally unsuitable for young children.

Due to the ever increasing need to provide safer toys especially for young children and also toys which offer the advantages as discussed above with respect to increasing child participation, stimulating motor skills and the like, many new toy designs are being proposed having large operating components which are made of materials which are less hazardous to children. Further, designers are being more cautious to develop structures which will be less likely to create or cause injury in use. Unfortunately, many of such structures have effectively limited the types of toys which have been made available to children.

In designing toys suitable and appropriate for children, a primary consideration is developing a toy which will immediately stimulate the interest of the child. Over the years, use has been made of rotating interlocking elements to create a series of movable displays which are very effective in attracting the attention of especially young children. In U.S. Pat. No. 3,881,274, one such type of toy is disclosed having a plurality of components which have interlocking base members with gear elements extending outwardly therefrom in such a manner that the gears mesh with one another and serve to rotate displays which are mounted above the base members. In this manner, children can operate a handle mechanism provided on one of the elements or members and simultaneously cause the rotation of the displays carried by other intermeshing elements. This type of toy allows children to assemble components into an interlocking or meshing relationship in various random orders and does provide for an animated use after the toy has been assembled. Such a toy does, however, require advanced degrees of motor skill in assembling the interlocking components so that the gear teeth align with one another on each of the separate meshing elements or members. Further, the rotating gears are only partially encased and therefore may become fouled or clogged by threads or dirt or other materials and may also bind or catch or snarl on clothing and the like and are therefore not entirely appropriate for use with all ages of children. Another toy having intermeshing gear elements for causing simultaneous movement of parts is disclosed in U.S. Pat. No. 3,965,610 to Ouden.

As previously mentioned, one of the prime factors in developing toys is to develop toys having not only play but educational value. With respect to the toys discussed above which have been developed utilizing interlocking or intermeshing gear drives, the gear mechanisms themselves have necessarily generally been obscured or hidden. With the need for safety, most toys utilizing gears or meshing components insure that such components or elements are remotely positioned or hidden so that children cannot accidentally contact the gears due to the potential for injury if a finger or other appendage would be caught between such gear elements. Unfortunately, the movement of gears relative to one another is not only entertaining but it is also educational and can be utilized to teach children about relative rotary motion and also demonstrate the distribution of energy and motion along a chain of rotating elements.

In U.S. Pat. No. 3,212,200 to Lundberg, a gear device is disclosed which is designed to stimulate an individual's interest in mathematics. The assembly includes a plurality of intermeshing gears of varying sizes which can be utilized not only to teach the differences in rotational velocities but also the transfer of motion from one element to another. As discussed above, such a device is particularly designed for educational purposes and not designed for play by a child without supervision. Due to the exposed gear elements utilized in such a teaching device, it is not appropriate nor suitable for children who are unattended. A similar type instructional device or game is disclosed in U.S. Pat. No. 3,193,293 to Schaper. As with the prior reference, this type of intermeshing gear structure is not appropriate for use by young children and was probably not designed with that purpose in mind.

Some additional examples of prior art toys having meshing components or assemblable toys are disclosed in U.S. Pat. No. 2,692,443 to Milligan and U.S. Pat. No. 2,919,516 to Schaefer.

SUMMARY OF THE INVENTION

This invention is directed to assemblable toys having a plurality of intermeshing components which will enable characters or figures to be constructed having animated body parts. The toys of the present invention incorporate skeletal frames which may include preformed body portions and which skeletal frames are selectively utilized to support a plurality of one or more styles, shapes and sizes of gear or cogwheel-like elements so that such elements are assembled in intermeshing relationship with respect to one another. Once the intermeshing elements have been placed upon the skeletal frame, large threaded fasteners may be secured to the threaded ends of the frame elements to secure the rotating components in their meshed relationship.

The primary and exposed meshed gear elements of the present invention are constructed of a soft, yieldable, sponge or rubber like material so as to be easily deformable in the event a child's hands or other body part are inserted between the meshed elements. In addition, each of the structural or skeletal frames for the toys of the present invention is designed so that the gear elements are generally presented or oriented outwardly of the frame a sufficient distance so that at least one of the gear elements may be contacted with an adjacent support surface, floor, wall or the like so that the toy may be transversely moved across such surface to generate motion through friction to the contacting meshing elements or components. In this manner, the toy, when assembled will become animated as the toy is moved relative to a contacted surface.

In one embodiment of the invention, a stand-up character such as a clown is created by utilizing a frame having a pedestal base which will support the frame in an upright position. The frame includes a pair of outwardly extending leg portions which are joined at their uppermost ends to a shoulder component that extends generally parallel with respect thereto. A plurality of shorter vertically depending elements are disposed along the length of the shoulder member so as to provide supports for a plurality of meshing gear elements that will form the body portion of the character. Separate structural head and foot elements will be provided as necessary. In this embodiment, a first pair of roller gear elements are provided along the lowermost portion of the leg elements of the character and serve to provide an engaging rolling contact with a support surface. These rolling gear elements are intermeshed with special tubular gears having axially contacting male and female gear components provided at each end thereof. The tubular gears are designed to be intermeshed through a connecting gear with a plurality of standard or more conventionally shaped pinion-like gears or cogwheel components which are mounted to the vertical depending elements of the skeletal frames. Threaded fastening nuts are provided to secure the gears or cogwheel elements in place on each of the skeletal frame. In use, as the clown or other character is pushed along the support surface, motion from the supporting roller gear elements will be translated through the different tubular gear elements causing relative motion to be established along the entire body portion of the character.

In other embodiments of the invention, a skeletal frame is provided having a plurality of spaced transverse rod portions having threaded ends. A plurality of elongated gears or cogwheels which may have differing diameters are mounted to the transverse rod portions so as to be in intermeshing relationship with respect to one another and are secured in place by utilizing end caps which are screwed to the ends of such transverse rod portions. The skeletal frames of other embodiments of the invention are designed to support at least one of the gears or cogwheels of the present invention in position to contact a support surface so that motion may be generated from the contacting gear element to the other meshing gears as the toy is maneuvered relative to a support surface.

It is a primary object of the present invention to provide toys, especially for use by young children, which have utility not only in generating children's interest as toys but which also enhance children's motor skills by requiring the assembly and disassembly of components and which thereafter retain children's interest and also exhibit educational values in creating animated objects which are formed by a plurality of meshing gear and cogwheel elements which are placed in rotational motion upon movement of the toy relative to a support surface.

It is another object of the present invention to provide a toy which may be assembled and disassembled by young children and which is constructed of components which are easily handled and manipulated by small children and which components are manufactured of safe materials. In this respect, the toys include intermeshing cogwheel or gear elements which are formed of a sponge rubber or other soft and yieldable material so that the intermeshing elements are entirely safe for use by children even if a child were to insert a finger or other appendage between the elements when in use.

It is a further object of the present invention to provide toys which have utility in stimulating motor control by requiring the assembly of components but which also may be utilized in an assembled stage as animated toy characters which have moving body parts which will retain the interest of children when the toys are in use.

It is yet another object of the present invention to provide toys having skeletal frame portions which will support standardized body components which are generally gear-like in operation so that the gear-like components may be selectively interchangeable between certain skeletal frames as desired.

It is also an object of the present invention to provide a toy which has educational value in that it provides an exhibit of intermeshing rotary motion with different sizes of cogwheels and gears being utilizable with the toy so that the rotational movement of differing components may be readily discerned by an individual playing with the toy and wherein the individual will also learn that power may be generated and transferred from one rotating element to another along a chain of such elements.

BRIEF DESCRIPTION OF THE DRAWINGS

FIG. 10 is a side view of the structural frame element of FIG. 9 having the cogwheel elements of FIG. 11 incorporated therewith.

FIG. 10*a* is a perspective view of another embodiment of the cogwheel similar to that of FIG. 4.

FIG. 11 is another embodiment of the present invention showing another character having a skeletal frame upon which the cogwheel elements as shown in FIG. 10*a* are selectively mounted.

DESCRIPTION OF THE PREFERRED EMBODIMENT

Figure 9:
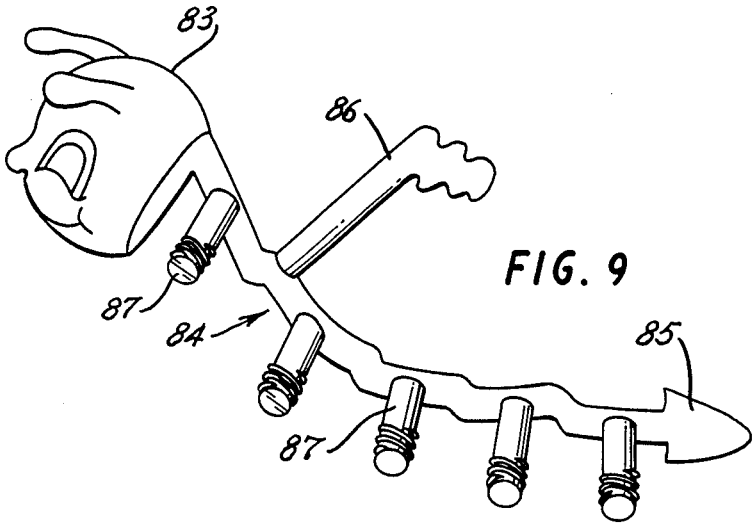
FIG. 9 is another embodiment of the present invention showing a different structural skeletal frame for supporting the gear or cogwheel elements of the present invention.

With continued reference to the drawings, the toys of the present invention will be discussed in several modifications. The first modification is disclosed in FIGS. 1–3 wherein the embodiment discloses a toy in the configuration of a clown. FIGS. 4–8 and 10*a* disclose various types of cogwheels or gearing elements which are utilized with the present invention. FIGS. 9 and 10 reflect a second embodiment of the invention whereas FIG. 11 is yet a further embodiment of the present invention.

Figure 1:
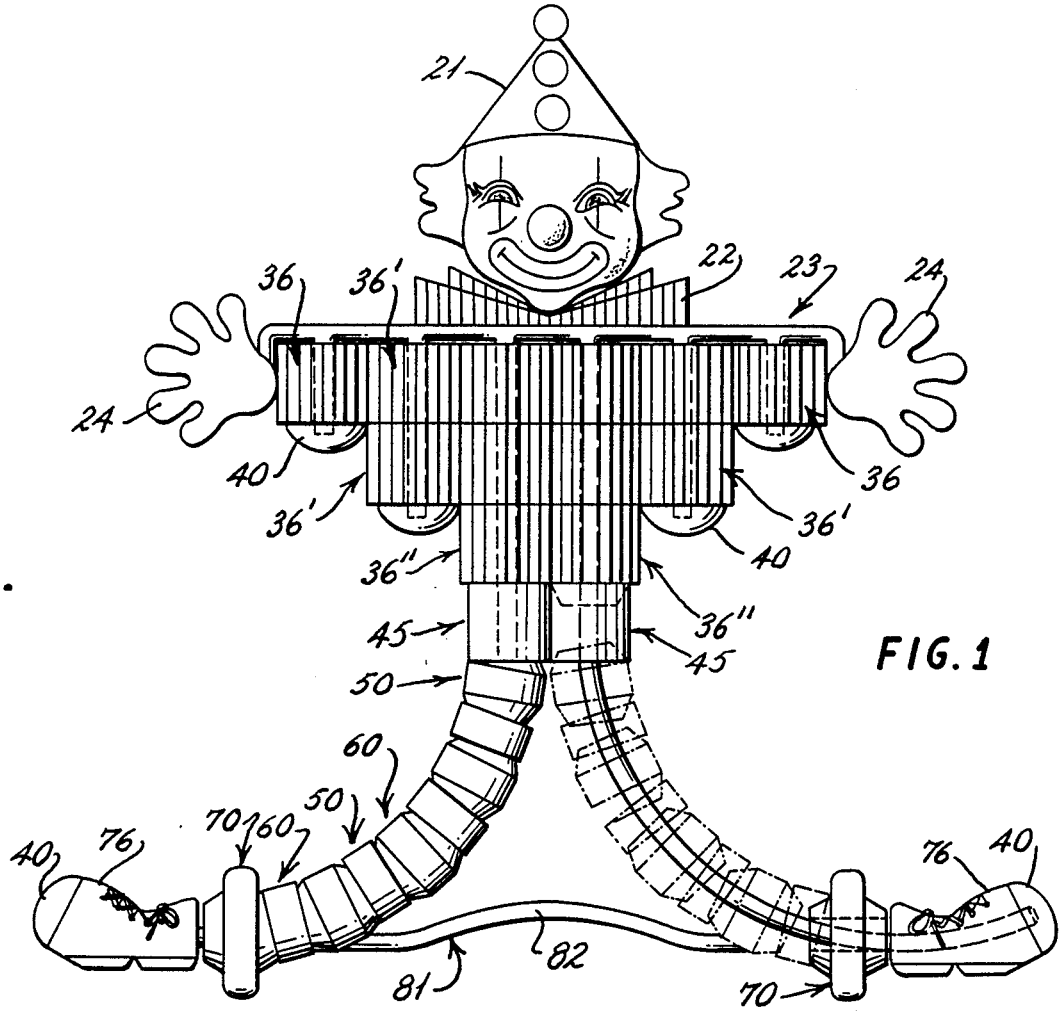
FIG. 1 is a front plan view of a first embodiment of the present invention showing a plurality of differing cogwheels or gear elements being mounted in intermeshing relationship with respect to a frame which is configured to resemble a clown.
Figure 2:
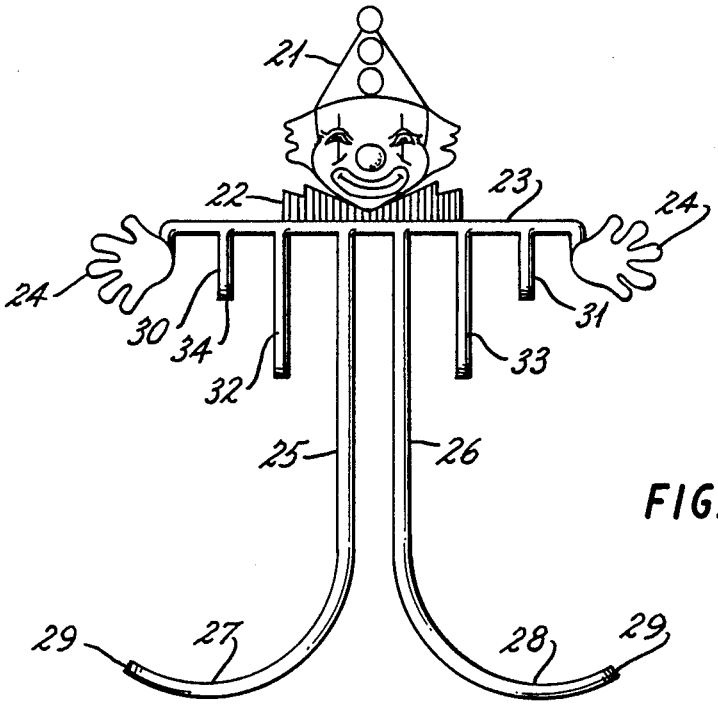
FIG. 2 is a front plan view of the skeletal portion of the clown of FIG. 1 on a reduced scale and showing the various skeletal components to which the gears shown in FIG. 1 are mounted.
Figure 3:
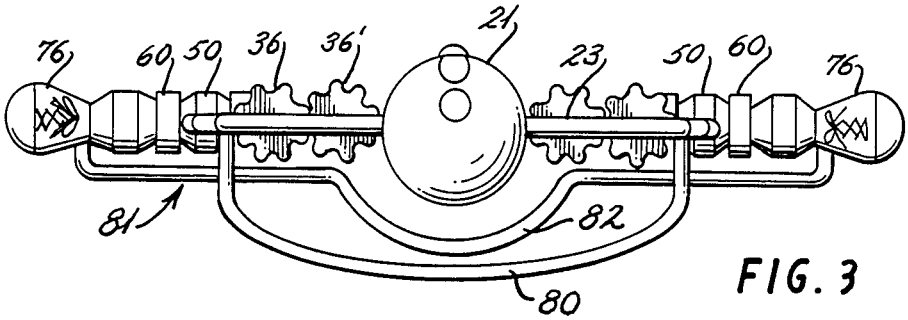
FIG. 3 is a top plan view of the assembled toy shown in FIG. 1.
Figure 4:
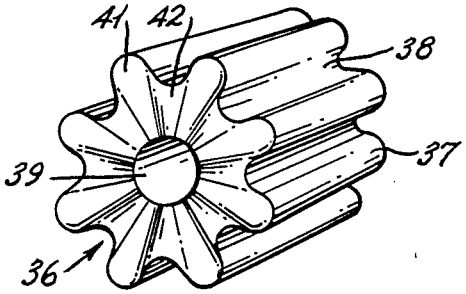
FIG. 4 is a perspective view of an elongated gear or cogwheel which is utilized with the toys of the present invention both with respect to the embodiment of invention shown in FIGS. 1–3.
Figure 5:
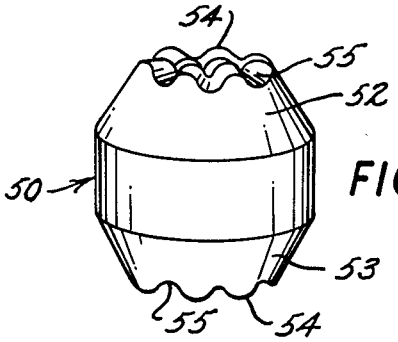
FIG. 5 is an illustrational view of a second form of gear element utilized with the embodiment of FIGS. 1 and 3.
Figure 6:
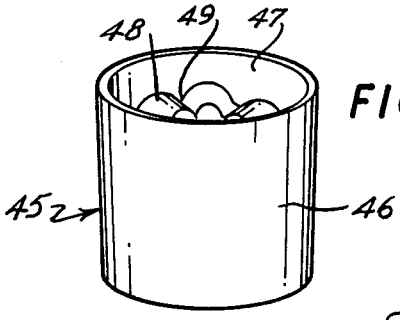
FIG. 6 is a perspective view of another modified form of gear element utilized in the form of the invention of FIGS. 1–3.
Figure 8:
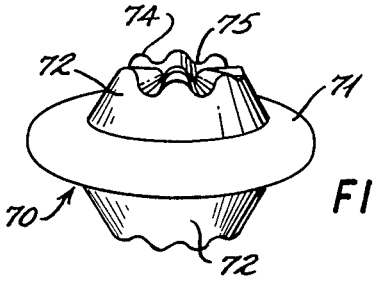
FIG. 8 is another modified gear element utilized in incorporatin with the invention of FIGS. 1–3.
Figure 7:
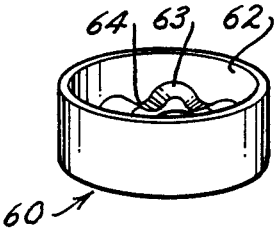
FIG. 7 is another modified form of gear element utilized in the form of the invention of FIGS. 1–3.

With specific reference to FIGS. 1–3, in the first embodiment of the invention, a clown toy 20 is disclosed having a head portion 21 which is mounted by way of a connector or neck portion 22 to a transversely extending body and arm skeletal frame 23. A pair of spaced hand portions 24 are mounted at each end of the body and arm skeletal member 23. A pair of spaced elongated skeletal leg portions 25 and 26 depend from the body and arm skeletal member 23 downwardly forming a pair of outwardly extending foot portions 27 and 28, respectively. The outermost ends of the curved foot portions 27 and 28 are threaded as shown at 29 for purposes of receiving special cap screws which will be disclosed in greater detail hereinafter.

The skeletal frame of the clown 20 further includes a plurality of spaced vertically depending skeletal members which are integrally formed with the body and arm skeletal member 23. The number of the depending members may vary, however, as shown in FIGS. 1 and 2, in this embodiment of the invention, the skeletal frame is provided with two outer depending frame portions 30 and 31 which are of a first length and two inner depending portions 32 and 33 which are approximately twice as long as the outer portions 30 and 31. The ends of each of the depending skeletal frame portions are also threaded as shown at 34. It should be noted that each of the depending elements 30, 31, 32 and 33 are generally equally spaced with respect to one another and with respect to the depending leg portions 25 and 26. In this manner, each of the elements is equally spaced along the length of the body and arm skeletal portion 23. This spacing is necessary in order to insure that the elements which will be mounted to the skeletal frame may be positioned on any one of the skeletal members without effecting the operation of such elements.

During the assembly of the clown shown in FIG. 1, a plurality of differing cogwheel or gear elements will be mounted to the skeletal frame members. When assembling the various cogwheels or gears, a first cogwheel or gear element 36 will be inserted over the outermost depending elements 30 and 31. The cogwheel 36 includes a plurality of generally rounded teeth 37 which are equally spaced around the periphery of the cogwheel and which define a plurality of rounded grooves 38 therebetween. As shown, the cogwheels 36 are generally elongated and have an internal cylindrical passageway 39 formed axially therethrough. The diameter of the passageway 39 is just slightly greater than the diameter of the skeletal members to which the cogwheels will be mounted. The outermost cogwheels are positioned over the depending skeletal body portions 30 and 31 and thereafter an enlarged cap screw 40 is brought into threaded engagement with the threaded ends of such skeletal portions to retain the cogwheels 36 in place so that they are freely rotatable about each of the depending skeletal portions. Thereafter, a second pair of cogwheels 36′ are mounted in end to end relationship about each of the skeletal frame portions 32 and 33. Again, the cogwheels 36′ are retained in place by attaching cap screws 40 to the threaded end portions of the respective skeletal members.

In order that the cogwheels 36′ may transmit rotational motion vertically to the adjacent cogwheels 36′ in an end to end fashion, the cog wheels 36 and 36′ are uniquely designed having intermeshing end portions. With respect to FIG. 4, each end of the cogwheels 36 is provided with alternate lands and grooves or raised portions and detents 41 and 42, respectively. When the cogwheels are placed over the skeletal body portions, the cogwheels are aligned so that the raised portions 41 on one end of one cogwheel are seated within the depressed or groove portions 42 of the aligned adjacent cogwheel. In this manner, the ends of the cogwheels will mesh with one another thereby translating motion linearly between two or more inline cogwheels.

In continuing with the assembly of the toy clown 20, a set of three cogwheels 36″ are subsequently inserted over the upper portion of the skeletal leg members 25 and 26 in such a manner that their ends are meshed in a manner such as discussed with respect to the cogwheels 36′. After the cog wheels 36″ have been inserted in place, a pair of first generally cylindrical gear elements 45 are inserted upwardly along the skeletal leg portions 25 and 26 and brought into engaging and meshing contact with the raised and depressed portions 41 and 42 of the lowermost cog wheels 36″. With specific reference to FIG. 6, the first form of cylindrical gearing elements 45 are disclosed as having generally cylindrical and smooth outer walls 46 and upper and lower end portions 47 having a plurality of lands 48 and grooves 49 distributed radially therein. The lands and grooves 48 and 49 are spaced so as to properly mesh with the raised and recessed areas 41 and 42, respectively, formed on the ends of the cogwheels 36. In this way, rotational movement of the gear member 45 will be transmitted to the cogwheel elements 36. The recessed end portions 47 will allow the ends of the cogwheels 46 to be seated within the outer side walls of the gears 45 thereby insuring a driving contact between the two elements.

After the gear elements 45 have been inserted over the skeletal leg members 25 and 26, a series of second generally tubular or cylindrically shaped gear members 50 are inserted over the skeletal members 25 and 26. The gear members 50 include a generally cylindrical outer wall portion 51 and inwardly tapering end portions 52 and 53. Each of the end portions 52 and 53 is formed in generally the same configuration so that the gear element 50 may be assembled with either end being the leading end when placing the gear elements on the skeletal leg members as shown. Each of the tapering end portions 52 and 53 is further provided with a series of lands and grooves 54 and 55 which are of a size and shape to cooperatively mesh with the lands and grooves 48 and 49 of the gear elements 45. Further, the tapering end sections permit the ends of the gear element 50 to be inserted within the recessed wall portions 47 of the gear elements 45. In this manner, the driving connection between gear elements 45 and 50 is protected or covered by the outer walls 46 of the gear element 45. As the outer wall 46 prohibits any direct exposure of the gear elements, it is possible that the gear elements 45 and 50 may be made of a less resilient plastic material than the material from which the primary cogwheels 36 are manufactured.

As previously discussed, for purposes of safety, it is preferred that the cogwheels 36 are formed of a very soft and pliable material such as sponge rubber. However, the drive gear elements 45 and 50 may be formed of a harder plastic or a thermoplastic material as the intermeshing gear elements 48, 49, 54 and 55 are protected by and housed within the recessed side wall portions 47 of the gears 45.

As shown in FIG. 1, each of the gears 50 is interspaced by another socket element which will be referred to as recessed gear connectors 60 which include outer cylindrical side walls 61 which are equal in diameter to the side walls 51 of gear element 50 and side walls 46 of gear element 45. Each of the recessed connectors 60 includes recessed end portions 62 and centralized lands and grooves 63 and 64 which are equally spaced within the side walls 61 so as to mesh with the lands and grooves 54 and 55 of the cylindrical connector elements 50. Each of the recessed connectors 60 is spaced intermediate each of the gear elements 50. In this position, the recessed side walls of the recessed connector 60 provides a safety function and house or cover the intermeshing gear contact between gear elements 60 and 50. As with gear elements 45 and 50, the gear element 60 may be made of a somewhat harder plastic material than the cogwheels 36. This may not be always the case as each of the elements 45, 50 and 60 may be made of a softer sponge rubber component although the translation of energy or rotational movement between the elements would be somewhat effected by the use of a more pliable material.

With continued reference to FIG. 1, after a plurality of connectors 50 and 60 have been alternately spaced along each of the skeletal leg portions 25 and 26, to adjacent the lowest vertical point of such members, a pair of drive ground engaging gear elements 70 are mounted on each of the frame components 25 and 26. With specific reference to FIG. 8, the drive gear elements 70 include an outer annular wheel-like rim 71 which extends outwardly a sufficient distance so as to engage or contact a surface well in advance of any of the other portions of the toy. In this manner, when the toy is moved across a support surface, the rims 71 of the gear elements 70 will make rolling contact with the surface without any interference by the other components of the toy. In order to complete the driving contact between the various gear elements, the driven gear element 70 is provided with a pair of tapering end portions 72 and 73 which are identically configured with respect to one another and which are both provided with a series of lands and grooves 74 and 75 which are of a size to mesh with the lands and grooves 63 and 64 of the recessed connector gear elements 60. In this manner, as the rims 71 of the gear elements 70 are rotated, rotation will be translated to the tapered end portions thereof and transmitted through the mesh connections to the recessed connector 60 and from there through intermittent connections between the gear elements 60 and 50 and through the gear element 45 to each of the cogwheels 36, 36' and 36".

In an effort to give the toy of FIG. 1 a more realistic appearance, the drive gear element 70 may be secured in place by providing a fixed foot member 76 adjacent each of the drive gears. The fixed foot members 76 are secured in place by cap screws 40 which are threaded to the end portions 29 of the skeletal leg members 25 and 26.

With particular reference to FIG. 3, the toy clown of FIG. 1 is provided with a push handle 80 which extends from the main skeletal frame adjacent the body and arm portion 23. The handle member may be integrally formed or otherwise secured to the skeletal frame and is utilized to maneuver the toy across the support surface. A further stand component 81 is provided and attached between the shoe sections 76 of the toy so as to provide a stable base upon which the figure may be supported or propped when not in use. To further stabilize the toy figure, the central portion of the stand component 81 extends outwardly as shown at 82 so as to provide a three point type of contact for securely supporting the toy in a standing position.

In the use of the toy of FIG. 1, after a child has assembled the various gear elements to the skeletal frame, and secured such elements in place utilizing the appropriate cap screws, the toy may be pushed along a support surface thereby creating an animated effect created by the motion of the gear elements which form the body of the clown. To further accent the animation of the clown, each of the various gear elements may be differently colored or the same gear elements provided with multiple colors. In this manner, as the toy is moved across a surface, the differing colors will appear to move relative to one another thereby stimulating the child's interest in playing with the assembled toy.

The gear elements of the present invention may be utilized as discussed above with respect to any number of skeletal frame-like members. With respect to FIGS. 9–11, two additional embodiments of the invention will be disclosed in greater detail. It should be noted, however, that the two additional embodiments are only exemplary of other embodiments which could be formed utilizing the various gearing elements of the present invention. Further, although the discussion to follow will only incorporate the use of the very resilient cogwheels 36, it is possible that the other gear elements may also be utilized in other applications of the toy.

With specific reference to FIGS. 9 and 10, a second embodiment of the invention is disclosed wherein the skeletal frame is formed in the configuration of a worm-like caricature having a head 83 which is integrally formed or otherwise secured at one end of a skeletal body portion 84 which terminates in a tail section 85. The skeletal body portion 84 is shown as being somewhat curved and includes an upper handle member 86 which may be integrally formed with or secured to the central skeletal body portion 84 as preferred. A plurality of spaced transversely extending shaft elements 87 are integrally formed with the body portion 84. Although the shaft elements 87 may be equally spaced along the main skeletal portion 84, in the embodiment shown, the spacing between the elements has been varied for purposes of which will be discussed in greater detail hereinafter. Each of the ends 85 of the transversely extending shaft elements are threaded for purposes of receiving cap screws 40 as utilized in the embodiment discussed with respect to FIG. 1.

With reference to FIGS. 10 and **10*a*, in the assembly of the worm-like toy, a plurality of cogwheel or gear elements 88 are used which are generally similar to the cogwheel elements 36 disclosed in FIG. 1 except that the ends are generally planar as shown at 91. In this embodiment of the invention, a single cogwheel element is mounted upon each of the shafts 87 and thereafter the cap screws 40 are secured in place to retain the cogwheels in place. It should be noted that several different sizes of cogwheel elements 88 are utilized with the largest being designated generally at 88' and the smallest at 88". Each of the cogwheels includes a plurality of lands 89 and grooves 90** which mesh with respect to one another thereby causing an animated movement of the cogwheel elements with respect to one another. For purposes of educational understanding, the different sizes or diameters of cogwheels will create different peripheral velocities of the elements with respect to one another. As with the previous embodiment, the cogwheels may be formed of different colored material so as to further stimulate and attract the attention of a child and create a more visually animated effect.

For purposes of safety, the cogwheels 88 of this embodiment, are formed as the cogwheels of the previous embodiment and are soft and pliable being preferably formed of a sponge rubber material. In this manner, a child will not be injured if their hand is caught between any one of the intermeshing gear elements. In the use of the toy of this embodiment of the invention, once the varying sizes of cogwheels have been placed on the appropriate mounting shafts and the cap screws secured thereto, the toy may be utilized to create an animated effect. The child merely grasps the handle of the toy and urges the toy along a floor or other support surface so that the lowermost cogwheel element shown in 88' will be in driving contact with the support surface and thereby generate a drive motion which will in turn be transmitted to the remaining cogwheel elements.

With respect to FIG. 11 of the drawings, another embodiment of the present invention is disclosed. In this embodiment, the cogwheel elements 88 of the prior embodiment are shown as being utilized in a frame that is a replica of a dinosaur 95. The dinosaur is formed having a molded body portion 96 with depending leg portions 97 and 98 which surround a generally serpentine skeletal frame element 99. As with the embodiment of FIGS. 9 and 10, a plurality of transverse mounting studs or shafts (not shown) extend outwardly from the serpentine skeletal frame and serve to support a plurality of meshing cogwheel elements 88 in generally equally spaced relationship with respect to one another, when the cogwheels are of the same diameter. When different diameters of cogwheels are to be utilized, the spacing between each of the mounting shafts is varied as it was with respect to FIGS. 9 and 10. It should be noted that the lowermost cogwheel elements 100 of the present embodiment of the invention will act as the driving gears as such lowermost cogwheel engages the support surface when the toy is in standing position as shown in FIG. 11. By pushing the toy across the surface, the drive cogwheel 100 will be rotated thereby generating movement to the intermeshing cogwheels connected along the serpentine support or skeletal frame 99.

To facilitate the handling of the toy, an integral handle element 101 may be formed in the body of the dinosaur thereby creating an opening through which a child may place their hands in order to move the toy relative to the floor or other surface.

From the foregoing, it can be seen that any number and types of characters or skeletal body members can be designed for incorporation with the gears and cogwheels disclosed in the present invention. In some instances, the skeletal frame portions may be relatively uncomplicated as disclosed in the embodiment of FIGS. 9 and 10 whereas in other instances, the structure may be somewhat more detailed or complex having well defined body portions as shown with respect to the embodiment of FIG. 11. In addition, other toy creatures could be formed wherein a plurality of the gear elements shown in FIGS. 1–8 may be selectively utilized to transmit motion from one portion of the toy element to another to thereby allow for movement of different body portions or parts as such toys are manipulated.

We claim:

1. A toy apparatus comprising a body member, said body member having a head portion and a skeletal frame portion, said skeletal frame portion including at least two generally parallel oriented outwardly extending shaft means being spaced a first distance with respect to one another, at least one pair of flexible cogwheel means selectively mounted to said shaft means so as to be movable with respect thereto, means for securing said cogwheel means to said shaft means, said cogwheel means including a body portion having and outer periphery defined by a plurality of lands and grooves, said at least one pair of cogwheel means being of sufficient size so that the lands and grooves of each of said cogwheel means intermeshes with the adjacent of said cogwheel means when said cogwheel means are mounted to said shaft means, and said cogwheel means being resilient and easily deformed with respect to one another whereby when one of said cogwheel means is rotated by movement of the toy, the other of said cogwheel means will be rotatably moved in response thereto.

2. The toy apparatus of claim 1 in which said cogwheel means are of different colors.

3. The toy apparatus of claim 1 in which at least two of said cogwheel means are mounted in axial alignment and in contacting relationship to one another on at least one of said shaft means, said cogwheel means having intermeshing end portions defined by raised portions and detents, whereby the rotation of one of said at least two cogwheel means with respect to said at least one shaft means will cause the other of said at least two cogwheel means to be rotated by the engagement of said intermeshing end portions.

4. The toy apparatus of claim 1 in which said skeletal frame portion includes an elongated horizontal main frame, a plurality of said shaft means extending generally perpendicularly outwardly with respect to said main frame and being generally parallel with respect to one another, at least one of said cogwheel means mounted to each of said shaft means, said cogwheel means being of a size so as to intermesh with contiguous cogwheel means.

5. The toy apparatus of claim 4 in which said shaft means are spaced at varying distances with respect to one another, at least one of said cogwheel means being of different diameter that the other of said cogwheel means so that said at least one of said cogwheel means will rotate at a different peripheral velocity than said other of said cogwheel means.

6. The toy apparatus of claim 1 in which said means to retain said cogwheel means relative to said shaft means includes enlarged cap screw means, each of said shaft means having outer end portions, said cap screw means being threadingly engaged with said outer end portions of said shaft means.

7. The toy apparatus of claim 1 including at least first and second gear means removably mounted to said shaft means of said skeletal frame portion, each of said first and second gear means having outer wall portions and first and second end portions, said first and second end portions having a plurality of lands and grooves formed radially therein whereby said first and second gear means may be selectively united in meshing relationship with respect to one another in such a manner as to transmit motion generally linearly with respect to said shaft means.

8. The toy apparatus of claim 7 in which said skeletal frame portion includes a pair of downwardly extending leg means spaced between said shaft means and having upper and lower portions, said first and second gear means being alternately mounted along each of said leg means, drive gear means mounted adjacent said lower portion of said leg means and acting to transmit rotational energy to said first and second gear means, and means for retaining said first and second gear means and said drive gear means in meshed engagement along said leg means.

9. The toy apparatus of claim 8 including a handle means, said handle means extending from one side of said skeletal frame portion.

10. The toy apparatus of claim 9 including a base means, said base means connected to said lower portion of each of said leg means.

11. A toy apparatus of comprising a skeletal frame, said skeletal frame having an elongated generally curvilinear central portion having a head means formed at one end thereof and a tail means formed at the other end thereof, at least two of said spaced shaft means extending generally perpendicularly outwardly from said central portion of said skeletal frame so as to be generally perpendicular with respect thereto, at least one flexible gear means mounted to each of said outwardly extending shaft means, means for securing each of said gear means in rotational relationship with respect to said shaft means, each of said gear means having outermost lands and grooves defining intermeshing surfaces for meshing with an adjacent one of said gear means whereby motion or rotation of one of said gear means will cause rotation and motion with respect to the other of said gear means.

12. The toy apparatus of claim 11 in which said flexible gear means are of different colors.

13. The toy apparatus of claim 11 including handle means connected to said skeletal frame.

14. The toy apparatus of claim 11 including a plurality of said shaft means which are spaced apart at varying distances relative to one another, at least two sizes of said flexible gear means, said flexible gear means being mounted to said shaft means so as to be in meshing relationship with one another .

15. A toy apparatus comprising a skeletal frame portion including at least one skeletal arm member having outer end portions and a central portion, hand means formed at the outermost ends of said skeletal arm member, a pair of skeletal leg members depending from the central portion of said skeletal arm member, each of said skeletal leg members including upper portions and outwardly flaring lower end portions, at least one pair of shaft means depending from said skeletal arm member and spaced on opposite sides of said skeletal leg members, a first flexible gear means mounted to each of said depending shaft means and said upper portions of said skeletal leg members, each of said first gear means having outer surface portions defining a plurality of lands and grooves which intermesh with contiguous first gear means, said first gear means having opposite end portions, at least one of said opposite end portions having a plurality of radially oriented lands and grooves therein, second gear means mounted to said skeletal leg members adjacent to said first gear means, said second gear means having tapered upper and lower end portions having lands and grooves formed radially therein, connector means for drivingly connecting said lands and grooves of said second gear means with said lands and grooves at least one of said opposite end portions of said first gear means, a third gear means being mounted to said skeletal leg members, said third gear means having recessed upper and lower ends, a plurality of lands and grooves formed within said recessed upper and lower ends of said third gear means, said recessed lands and grooves of said third gear means being of a size and configuration to mesh with the lands and grooves of said second gear means, a drive gear means having outer hubs adapted to engage a supporting surface, said drive gear means being mounted to the lowermost portion of each of said skeletal leg members, said drive gear means drivingly engaging said third gear means, and means for retaining said drive means in intermeshing relationship with respect to said skeletal leg members of the assemblable toy.

16. The assemblable toy apparatus of claim 15 in which said connector means includes a gear element having a cylindrical housing having recessed end portions, and a plurality of lands and grooves formed radially within said recessed end portions.

17. The assemblable toy apparatus of claim 16 including stand means, said stand means including at least one elongated element having first and second end portions, said first and second end portions being joined adjacent said outermost end portions of said first and second leg members and extending rearwardly with respect thereto, whereby said base portion stabilizes the assemblable toy to allow the toy to stand as a three-dimensional character.

18. The assemblable toy apparatus of claim 17 in which said means for retaining said driven gear means with respect to said leg members includes simulated foot elements, and cap screw means for retaining said simulated foot elements to said lower portions of said leg members.

19. A toy comprising a skeletal frame having a head and body portion, said body portion having a plurality of shafts extending therefrom so that such shafts are generally parallel with respect to one another, a plurality of flexible gear means selectively mounted to said shafts, each of said flexible gear means having a plurality of lands and grooves which intermesh with the lands and grooves of adjacent flexible gear means when said flexible gear means are mounted to said shafts, and gripping means extending outwardly of said frame for facilitating the movement of said frame.

* * * * *